US005077936A

United States Patent [19]

Beaven

[11] Patent Number: 5,077,936

[45] Date of Patent: Jan. 7, 1992

[54] ADJUSTABLE HANGING BASKET

[76] Inventor: David G. P. Beaven, 999 Kangaroo Road, R.R. #2, Victoria, British Columbia, Canada, V9B 5B4

[21] Appl. No.: 495,610

[22] Filed: Mar. 19, 1990

[30] Foreign Application Priority Data

Sep. 29, 1989 [CA] Canada ..... 615320

[51] Int. Cl.[5] ..... A01G 9/02

[52] U.S. Cl. ..... 47/67; 248/330.1

[58] Field of Search ..... 47/67; 248/330.1

[56] References Cited

U.S. PATENT DOCUMENTS

| | | | |
|---|---|---|---|
| 400,856 | 4/1889 | Kintz | 248/330.1 |
| 1,363,444 | 12/1915 | Newell | 248/330.1 |
| 4,187,996 | 2/1980 | Ehrlich . | |
| 4,389,228 | 6/1983 | Leunig | 248/330.1 |
| 4,449,324 | 5/1984 | Ostarly | 47/67 |
| 4,556,184 | 12/1985 | O'Sullivan . | |
| 4,669,693 | 6/1987 | Kagan | 47/67 |
| 4,773,623 | 9/1988 | Nabinger . | |
| 4,825,589 | 5/1989 | Straw | 47/67 |

*Primary Examiner*—Henry E. Raduazo
*Attorney, Agent, or Firm*—John Russell Uren

[57] ABSTRACT

A hanging plant holder which is height adjustable. A cable wraps around a pulley enclosed in the base of the plant holder and attaches to a hook in a ceiling. A braking and release mechanism in the plant holder allows the pulley to move in such a fashion that the cable is lengthened or shortened.

11 Claims, 3 Drawing Sheets

ADJUSTABLE HANGING BASKET

INTRODUCTION

This invention relates to a plant holder which is height adjustable, and more particularly, a plant holder which has a self-contained adjustment mechanism for raising and lowering the plant holder.

BACKGROUND OF THE INVENTION

Hanging plant holders typically employ a non-adjustable set of cables attached to the plant holder at one end of the cables and to the usual ceiling hook at the other end of the cables. Watering and maintenance of contained plants is sometimes inconvenient, particularly if the plant holder is hung closely to the ceiling and the ceiling is high.

The height of plant holders has been adjustable, however, by way of cable retainers, such cable retainers typically being located adjacent to ceiling hook. Such cable retainers, however, are located apart from the plant holder and are, for the most part, unsightly.

SUMMARY OF THE INVENTION

According to one aspect of the invention, there is provided a height adjustable hanging basket comprising a plant holder, at least one cable extending from said plant holder and being operable to be connected to a ceiling hook and a cable retainer to retract and extend said cable, said cable retainer being positioned within said plant holder.

BRIEF DESCRIPTION OF THE SEVERAL VIEWS OF THE DRAWINGS

An embodiment of the invention will now be described, by way of example only, with the use of drawings in which:

FIG. 2(*b*) is a diagrammatic bottom view of the assembled plant holder of FIG. 2(*a*);

DESCRIPTION OF SPECIFIC EMBODIMENT

Figure 1:
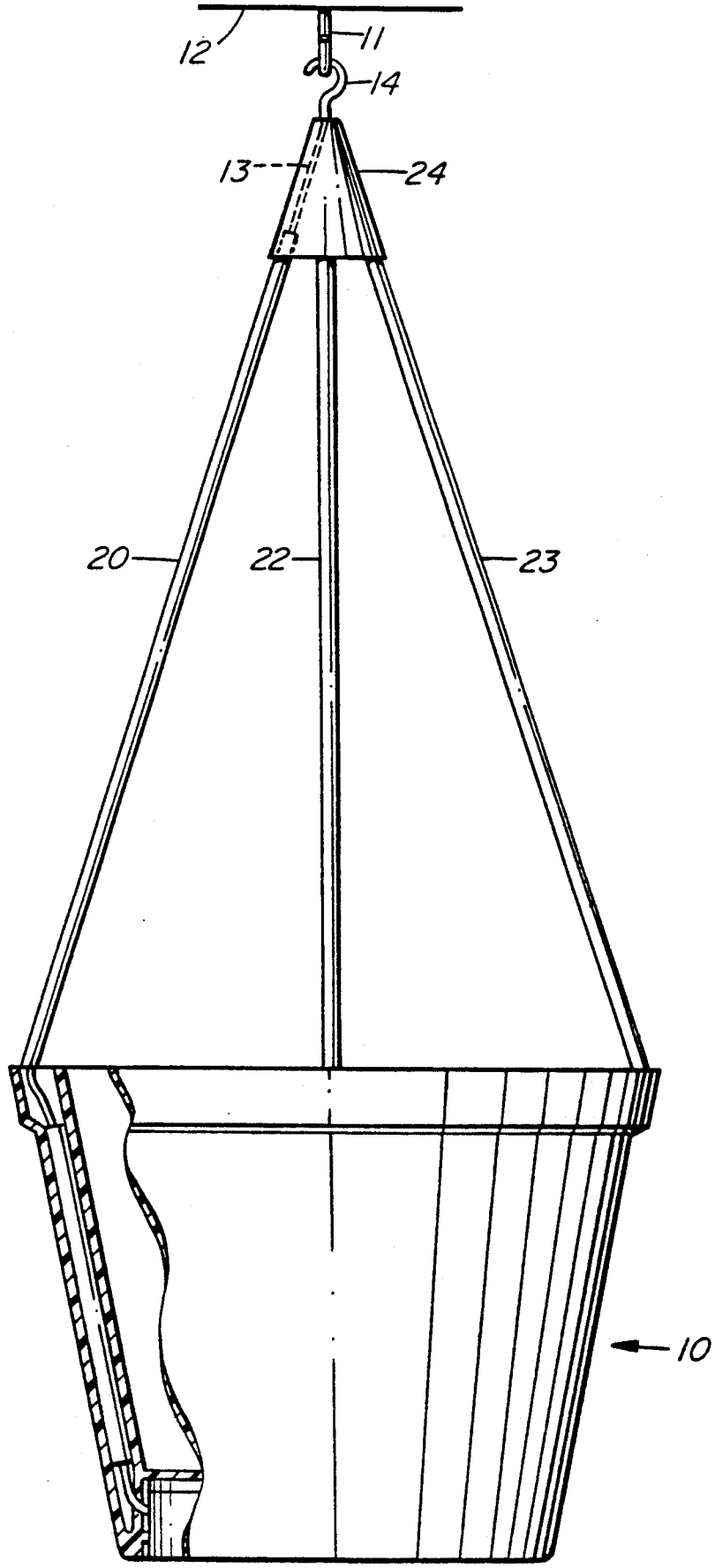
FIG. 1 is a diagrammatic partially sectional view of a first embodiment of the plant holder according to the invention.

Referring to FIG. 1, a plant holder or hanging basket is generally illustrated at 10. The basket 10 is supported from a hook 11 on the ceiling 12. A cable 13 extends from a second hook 14 which is mated with ceiling hook 11, through a sheath 20 to the periphery of basket 10 and, thence, to the cable braking and release mechanism generally illustrated at 21 (FIG. 2). Two further cables, 22, 23 are stationary and are connected directly to the upper circumference of basket 10 such that the basket 10 is supported by cables spaced equidistantly about its circumference as is known in the art. All of the cables, 13, 22, 23 extend from the basket 10 to a cable holder 24. Cables 22, 23 are connected directly to the cable holder 24.

Cable 13, however, is adjustable. It runs from hook 14 to the cable holder 24 and thence downwardly through the cable holder 24 such that the cable holder 24 may move relative to the cable 13. Cable sheath 20 is held in cable holder 24 and is stationary with respect to cable holder 24 and basket 10.

Figure 2A:
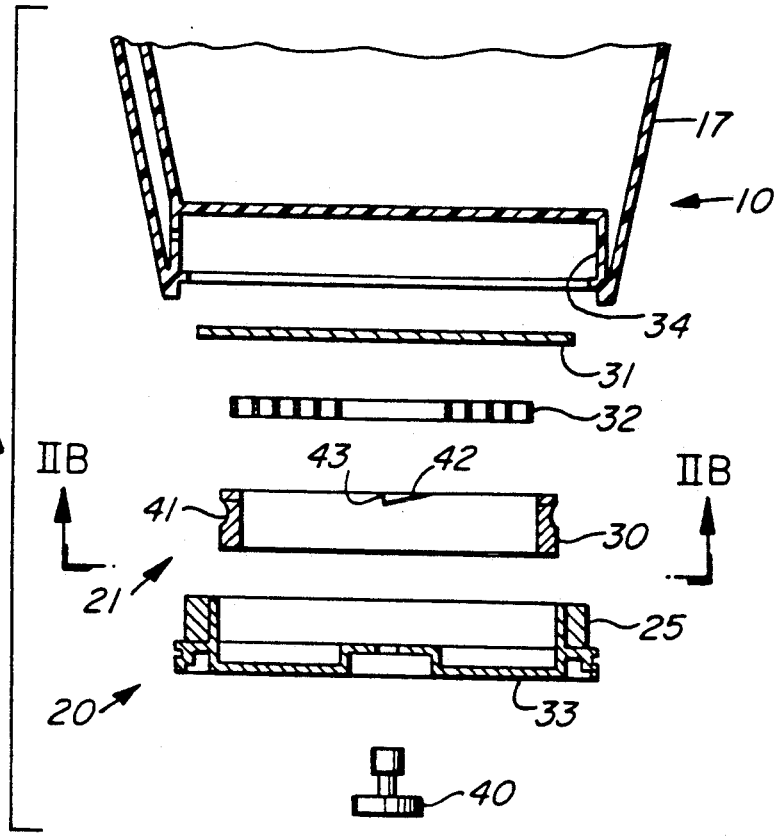
FIG. 2(*a*) is a diagrammatic exploded view of the plant holder and the cable reel according to the invention.
Figure 2B:
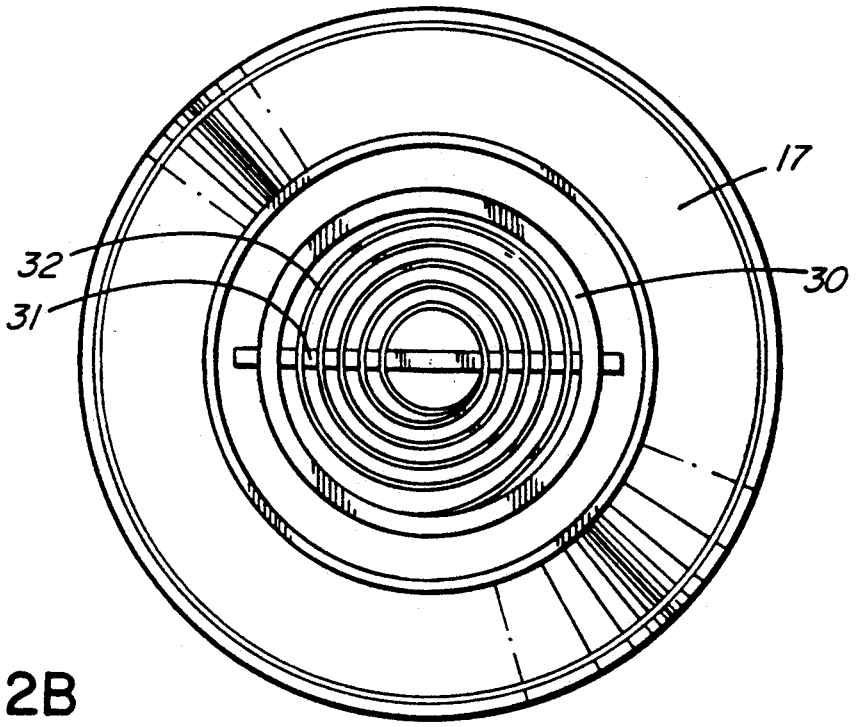

The cable 13 is connected to the braking and release mechanism 21 shown in more detail in FIG. 2A. The braking and release mechanism 21 comprises an elongate braking member 31 mounted over a torsion spring 32 which is mounted within pulley 30. Pulley 30 is mounted within a stationary main body 33 which is, in turn, mounted within the recess 34 of the basket 10. A release button 40 is mounted on the bottom of the main body 33. The cable 13 is mounted to pulley 30 around a peripheral groove 41 in the pulley 30.

In operation, it will be assumed the basket holder 10 is in the position illustrated in FIG. 1; that is, it is located near the ceiling 12 in a furthermost up position.

The user will then simply push up on button 40, disengaging brake 31 and allowing basket 10 to lower, for the purpose of watering the plant or otherwise and, as the basket 10 and cable holder 24 move downwardly, cable 13 will unwind from the cable braking and release mechanism 21.

As the cable 13 unwinds from groove 41, pulley 30 will rotate relative to the recess 34 and the torsion spring 32 will tighten as it is wound. When the button 40 is released, the braking member 31 will drop into slots 42 on the upper surface of pulley 30 while moving vertically in recess 25 of main body 33. The braking member 31 will abut the vertical edge 43 of the braking slots 42 and this will cause the movement of the pulley 30 to cease and, therefore, the downwardly movement of the basket 10 will also be terminated.

If the user desires the basket 10 to assume a position further downwardly, he will press the release button 40 upwardly. This has the effect of also pushing the braking member 31 upwardly thereby dislodging the braking member 31 from the braking slot 42 and allowing the basket to be moved downwardly a distance equal to the distance of another one-quarter rotation of the pulley 30. This operation continues until the desired height for the plant holder 10 is obtained. Of course, if the user desires to continuously lower the plant holder or basket 10 without having the braking member 31 stop the basket, the user will simply maintain pressure on the release button 40 such that the braking member 31 will stay out of the braking slot 42.

When the watering operation is completed or if the user desires to raise the plant holder 10, he will simply lift the basket 10 upwardly. Under the influence of the lifting force of the user, the plant holder 10 will move vertically as the torsion spring 32 causes the unused portion of the cable 13 to be rewound onto pulley 30. The braking member 31 will be ineffective when the basket 10 moves upwardly, since the braking slots 42 have only one vertical edge 43 and, therefore, the braking member 31 will simply slide over the braking slots 42 each revolution until the desired height of the basket 10 is achieved.

Figure 3:
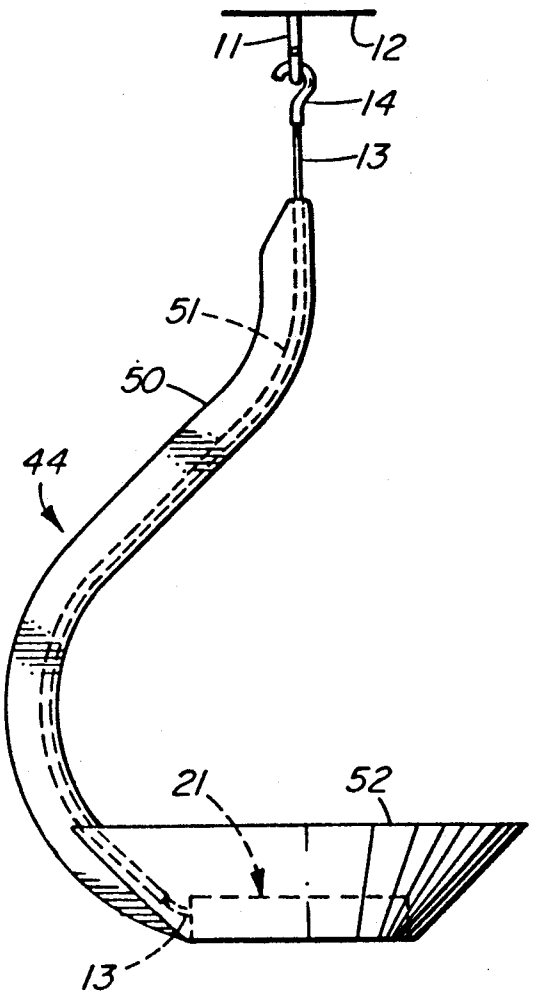
FIG. 3 is a diagrammatic partially sectioned side view of a further embodiment according to the invention.

A further embodiment of the invention is shown in FIG. 3. In this embodiment, the three cable support illustrated in FIG. 1 is replaced with a single support generally illustrated at 44. In this embodiment, the cable 13 remains attached to the ceiling hook 11 by hook 14 and the basket support 50 and the basket support sheath 51 move downwardly with the basket support tray 52.

The cable 13 is connected to the cable braking and release mechanism 21 in the same manner as with the FIG. 1 embodiment and the operation of the raising and lowering of the basket 44 is identical.

Figure 4:
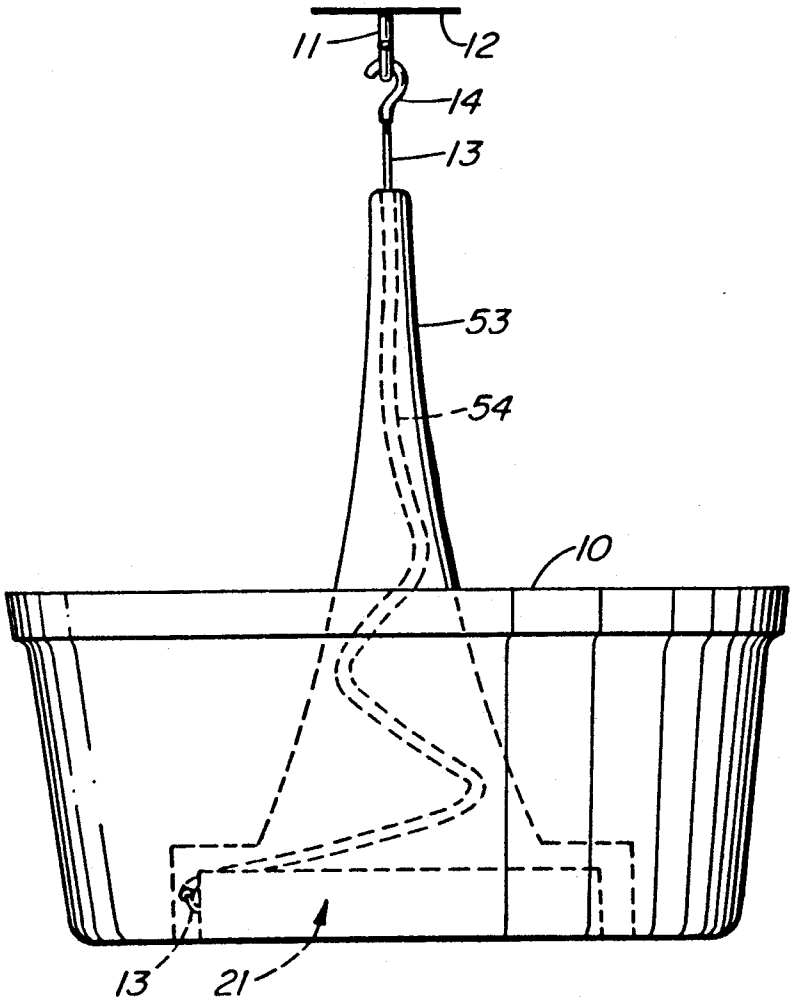
FIG. 4 is a diagrammatic partially sectioned side view of yet a further embodiment according to the invention.

Yet a further embodiment of the invention is illustrated in FIG. 4. In this embodiment, a single cable 13 to support the basket 10 is also used. This cable 13 runs through a central basket support 53 which acts to retain the cable sheath 54 which extends within the central basket support 53 to the braking and release mechanism 21 (not illustrated). The operation in raising and lowering the basket 10 is identical to that described in association with the embodiments shown in FIGS. 1 and 3.

It will be understood that while the term "cable" has been used to determine the support 13 extending from the basket 10 to the ceiling or cable support 24, it is clear that rope, twine, string, chain, wire and the like could also be used in accordance with the teachings of the invention and the term "cable" is intended to cover all such elements. It is further contemplated that the braking slots 42 are not limited to being located 90° apart. The number of slots could be increased such that they exist at 90° intervals of rotation or otherwise.

Many modifications to the invention will readily occur to those skilled in the art and the specific embodiments described should be taken as illustrative of the invention only and not as limiting its scope as defined in accordance with the accompanying claims.

I claim:

1. A height adjustable hanging basket comprising a plant holder, a single length adjustable cable extending from said plant holder, said cable being operable to be connected to a ceiling hook to suspend said plant holder from a ceiling in a position variably spaced from the ceiling and a cable retainer to retract and extend said cable, said cable retainer being positioned within said plant holder, and further comprising stabilizing means on said plant holder for maintaining the plant holder in a horizontal position.

2. A height adjustable hanging basket as in claim 1 wherein said plant holder has a base and said cable retainer is located within said base.

3. A height adjustable hanging basket as in claim 2 wherein said cable retainer is a braking and release mechanism.

4. A height adjustable hanging basket as in claim 3 wherein said length adjustable cable is connected to a pulley of said braking and release mechanism, said pulley being biased by a spring.

5. A height adjustable hanging basket as in claim 4 wherein said spring is a torsion spring, said torsion spring being wound tighter when said basket is lowered and being unwound when said basket is raised.

6. A height adjustable hanging basket as in claim 5 wherein said braking and release mechanism stops said pulley when said basket is lowered to a predetermined location.

7. A height adjustable hanging basket as in claim 1, further comprising a cable support sheath which is fixed relative to said stabilizing means, said length adjustable cable extending through and being movable relative to said sheath.

8. A height adjustable hanging basket as in claim 7, wherein said stabilizing means comprises a basket support extending from one side of said plant holder.

9. A height adjustable hanging basket as in claim 7, wherein said stabilizing means comprises a basket support being centrally located and extending upwardly from said plant holder.

10. A height adjustable hanging basket as in claim 7, wherein said plant holder comprises a pot in which a pot plant can be planted.

11. A height adjustable hanging basket as in claim 7, wherein said stabilizing means comprises a cable holder, said cable support sheath extending between said cable holder and said plant holder, and a plurality of cables of constant length connected between said plant holder and said cable holder.

* * * * *